US010791790B2

(12) United States Patent
Morales

(10) Patent No.: US 10,791,790 B2
(45) Date of Patent: Oct. 6, 2020

(54) HOOD WITH CAP-SECURING SYSTEM

(71) Applicant: Angel L. Morales, San Francisco, CA (US)

(72) Inventor: Angel L. Morales, San Francisco, CA (US)

(73) Assignee: Angel L. Morales, Daly City, CA (US)

( * ) Notice: Subject to any disclaimer, the term of this patent is extended or adjusted under 35 U.S.C. 154(b) by 305 days.

(21) Appl. No.: 15/645,960

(22) Filed: Jul. 10, 2017

(65) Prior Publication Data

US 2018/0007995 A1 Jan. 11, 2018

Related U.S. Application Data

(60) Provisional application No. 62/493,686, filed on Jul. 11, 2016.

(51) Int. Cl.

| | |
|---|---|
| ***A42B 7/00*** | (2006.01) |
| ***A42B 1/06*** | (2006.01) |
| ***A41D 1/04*** | (2006.01) |

(52) U.S. Cl.

CPC ..... *A42B 7/00* (2013.01); *A41D 1/04* (2013.01); *A42B 1/062* (2013.01); *A41D 2200/20* (2013.01); *A41D 2300/33* (2013.01)

(58) Field of Classification Search

CPC .. A42B 7/00; A42B 1/062; A41D 1/04; A41D 2300/33; A41D 2200/20

See application file for complete search history.

(56) References Cited

U.S. PATENT DOCUMENTS

| | | | | | |
|---|---|---|---|---|---|
| 4,180,868 | A * | 1/1980 | Snow | A42B 3/105 | 2/172 |
| 5,046,195 | A * | 9/1991 | Koritan | A41D 13/0512 | 2/172 |
| 5,048,128 | A * | 9/1991 | Watson, Jr. | A42B 1/066 | 2/171 |
| 5,153,943 | A * | 10/1992 | Clement | A42B 1/067 | 2/172 |
| 5,161,260 | A * | 11/1992 | Reynolds | A42B 1/066 | 2/171 |
| 5,400,440 | A * | 3/1995 | Clifford | A42B 1/067 | 2/172 |
| 5,448,778 | A * | 9/1995 | Phillips | A42B 1/067 | 2/172 |
| 5,790,986 | A * | 8/1998 | Hall | A42B 1/066 | 2/172 |
| 5,875,493 | A * | 3/1999 | MacDonald | A01K 55/00 | 2/10 |
| 5,950,888 | A * | 9/1999 | Nolan-Brown | A42B 1/004 | 2/209.13 |

(Continued)

*Primary Examiner* — Khaled Annis

(74) *Attorney, Agent, or Firm* — Kilpatrick Townsend & Stockton LLP

(57) ABSTRACT

A piece of apparel comprises a hooded garment, a cap having a front, and a securing system associated with the hood of the hooded garment. The securing system comprises a band that contacts the front of the cap and secures the cap to a wearer's head when the hood is up and that secures the cap within the hood with the hood is down. The band extends from one side of the interior of the hood, across the front of the cap and to the other side of the interior of the hood. The band can comprise an elastic portion so that the band compresses the front of the cap when in use.

8 Claims, 11 Drawing Sheets

(56) References Cited

U.S. PATENT DOCUMENTS

| | | | | |
|---|---|---|---|---|
| 6,029,278 | A * | 2/2000 | Lopez | A41D 13/08 2/16 |
| 7,310,829 | B1 * | 12/2007 | Engel-Wilson | A42B 1/067 2/175.6 |
| 2007/0118960 | A1 | 5/2007 | Goodwin | |
| 2010/0306898 | A1 | 12/2010 | Aurum | |
| 2014/0317829 | A1 | 10/2014 | Rolfe | |

* cited by examiner

HOOD WITH CAP-SECURING SYSTEM

PRIORITY

The present application claims the benefit of domestic priority based on U.S. Provisional Patent Application 62/493,686 filed on Jul. 11, 2016, the entirety of which is incorporated herein by reference in its entirety.

BACKGROUND

In recent years, hooded garments have become a popular item of clothing. While the origin of the hood can be traced back to medieval times and the hooded robes worn by monks, today hoods have widespread appeal. The hooded sweatshirt, often called a hoodie, in particular is now a well-entrenched item of apparel in popular culture and is a staple of fashion for the millennial generation. Hoods are also common on jackets, capes, shirts, dresses, and many other items of clothing and are now as likely to be seen on a fashion show runway as they are at an athletic event. Typically, the hood will come with a drawstring that encircles the opening at the front-facing portion of the hood. The drawstring may be pulled and tied below a wearer's chin in order to keep the hood on during wind or movement.

Billed caps, such as a traditional baseball cap, have also seen a surge in popularity. An item that originally served the utilitarian purpose of using its bill or brim to block the sun from an athlete's eyes is now worn regularly by millions of users both indoors and out. According to the U.S. Bureau of Labor Statistics, over 43 million baseball hats are sold in the United States every year, and the annual hat sales industry revenue is over $2 billion. The billed caps have a front banner portion that often includes the logo of a baseball or other sports team, such as the New York Yankees or the San Francisco Giants. The banner portion may also contain other images, such as the logo of a business or organization, a motto or phrase, a name, picture or drawing, or it may simply be blank. The caps are often worn for the purpose of promoting a product or idea, for making some sort of statement, and/or for demonstrating a sense of style. In recent years, the banner has even been used to promote political candidates and to associate oneself with a political party or philosophy. For whatever the reason, it is generally important to the wearer that the banner of the cap be visible to others.

Recently it has become in vogue to wear a billed cap under a hood. Though both fashionable and functional, the wearing of the two items together poses some difficulties. For example, in order to keep the hood secure on the head, the wearer typically must pull and tie the drawstring of the hood which will often result in the top of the hood covering the banner of the billed-cap. Furthermore, one of the advantages of a hood is that the hood is attached to the back of a garment thereby allowing the hood to be removed from the head in a simple motion. When removed from the head, the hood remains attached to the garment and both hands remain free. However, when a cap is worn under a conventional hood, this advantage is lost because the cap is not attached to the garment. After the cap is removed from the user's head, it must be held in the user's hand or set down in a place where it can be easily lost or stolen.

Therefore, there is a need for a system that allows a hood and a billed cap to the worn together in a convenient and/or comfortable manner. It is further desirable to be able to wear a hood and a billed cap together in a manner that does not obstruct the banner portion of the cap. It is still further desirable to be able to keep a billed cap attached within a hood when the cap and hood are doffed. And it is additionally desirable to be able to hold accessories with a hood and/or cap.

SUMMARY

The present invention satisfies these needs. In one aspect of the invention, a system is provided that secures a cap within the hood of a hooded garment.

In another aspect of the invention, apparel comprises a hooded garment, a cap having a front, and a securing system associated with the hood of the hooded garment, wherein the securing system comprises a band that contacts the front of the cap and secures the cap to a wearer's head when the hood is up and that secures the cap within the hood with the hood is down.

In another aspect of the invention, an article of apparel comprises a hooded garment, and a securing system associated with the hood of the hooded garment, the securing system comprising a band that extends across the opening of the hood to secure one or more objects within the hood, wherein the band has a length, a width and a thickness and wherein the width of the band in the vertical direction when the hood is up is about 1.125 inches or less.

In another aspect of the invention, an article of apparel comprises a hooded garment, and a securing system associated with the hood of the hooded garment, the securing system comprising a band that extends across the opening of the hood to secure one or more objects within the hood, wherein the band is removably attachable to the interior of the hood.

In another aspect of the invention, a method of wearing a hooded garment comprises providing a band within the interior of the hood, positioning the band in front of a cap to secure the cap against a wearer's head when the hood is up and to secure the cap within the hood when the hood is down.

In another aspect of the invention, a method of wearing a hooded garment comprises providing a band within the interior of the hood, positioning the band in front of a cap to secure the cap against a wearer's head when the hood is up and to secure the cap within the hood when the hood is down, and adjusting the length of the band.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to an article of apparel and a method of wearing an article of apparel. In particular, the invention relates to a hooded garment and a securing system for holding an item in the hooded garment. Although the invention is illustrated and described in the context of being useful for securing a cap within the hood, the present invention can be used in other ways, as would be readily apparent to those of ordinary skill in the art. Accordingly, the present invention should not be limited just to the examples and embodiments described herein.

Figure 1:
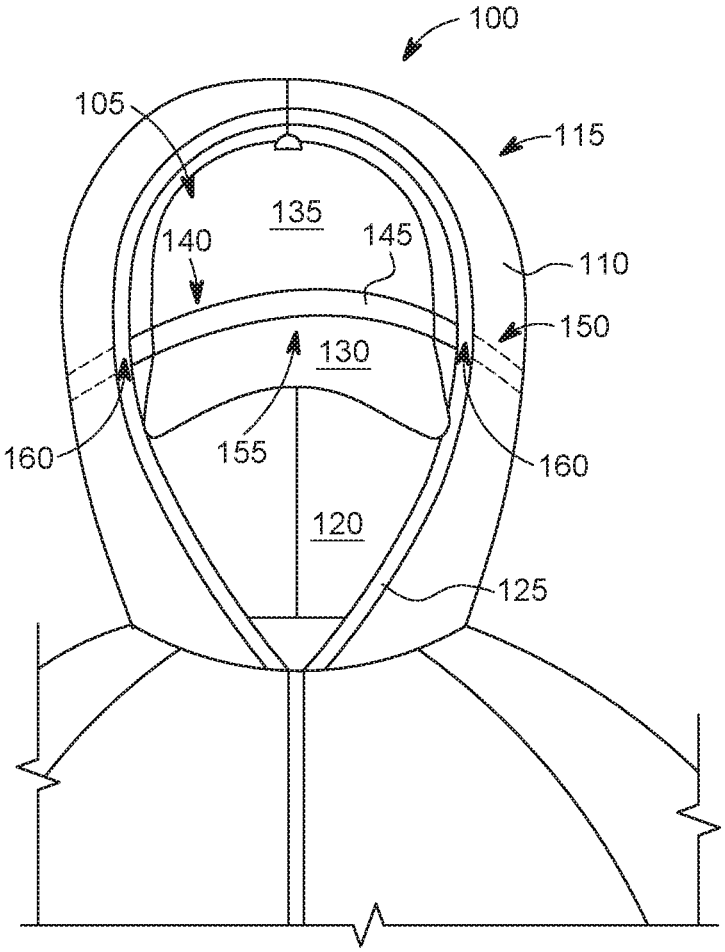
FIG. 1 is a schematic front view of an article of apparel in accordance with one version of the invention with the hood of a hooded garment up.

FIG. 1 shows apparel 100 including a cap 105 and/or a hooded garment 115. According to one version of the invention, the apparel 100 is useful for securing the cap 105 inside the hood 110 of the hooded garment 115. The hooded garment 115 may be any article of clothing that includes a hood 110, such as a hooded sweatshirt or hoodie. The hood 110 includes an interior portion 120. When the hood 110 is pulled forward and worn by a wearer of the hooded garment 115, the wearer's head fits within the interior portion 120 of the hood 110 (the head of the wearer is not shown in FIG. 1 for the sake of clarity). The hood 110 may optionally include a conventional drawstring system 125 where a drawstring resides within a front portion of the hood 110 and extends around the front opening of the hood 110. As shown in FIG. 1, the wearer may also wear a cap 105 while wearing the hood 110 of the hooded garment 115. The cap 105 may be a conventional billed-cap such as a baseball-style hat and can include a bill 130 that extends over the eyes of the wearer and is designed to provide shade from the sun, and a head portion 135 that fits over the top of the wearer's head.

In accordance with the apparel 100 of FIG. 1, the wearer may secure the cap 105 within the hood 110 by using a securing system 140. In the version of FIG. 1, the securing system 140 includes a band 145 that is attached to the inside of the hood 110. The band 145 extends across the front opening of the hood 110, around the front of the cap 105 along the head portion 135 and above the bill 130. The securing system 140 is designed so that the band 145 serves to hold the cap 105 and the hood 110 together on the head of the wearer.

The securing system 140 offers several advantages over conventional hoods that lack a securing system 140. For example, with the securing system 140, the hood 110 can be maintained on top of the head of a wearer without having to use a drawstring. Drawstring attachments can be uncomfortable and cumbersome. In addition, often a drawstring will pull a hood to a greater extent in a forward direction than a wearer desires. A forward-pulled hood can cover the eyes and/or may cover too much of the cap 105. In addition, tying and untying the drawstrings can be inconvenient and difficult, particularly when the user is engaged in an activity or has items in his or her hands. Furthermore, many wearers find it fashionable to wear their hood 110 more on the back portion of the head. With the securing system 140 of the present invention, the hood can be secured at a lower position on the head than would be easily accomplished using a drawstring.

Figure 2A:
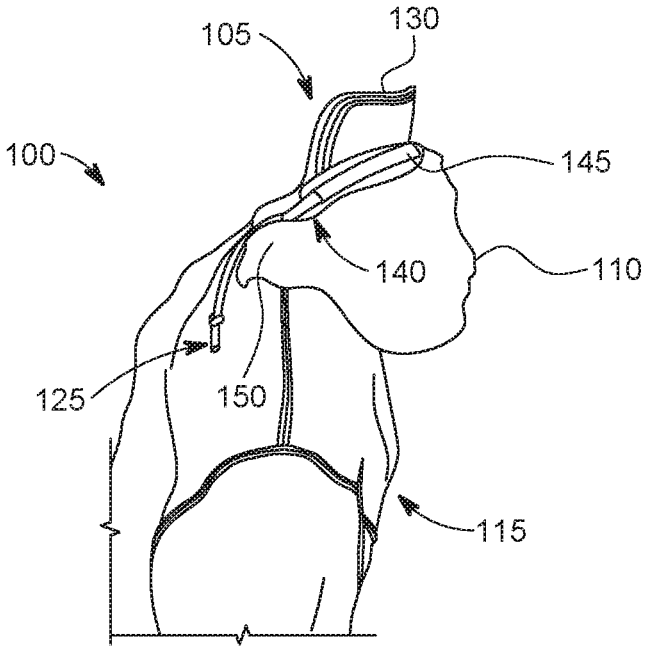
FIGS. 2A and 2B are schematic side and rear views, respectively, of the article of apparel of FIG. 1 with the hood down.
Figure 2B:
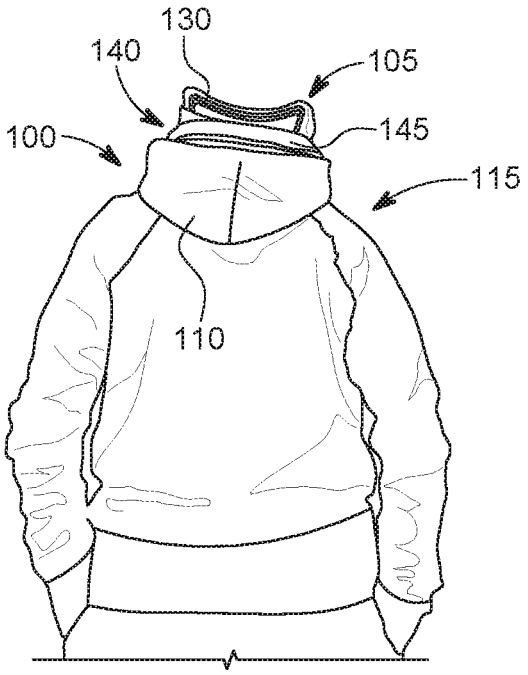

As illustrated in FIGS. 2A and 2B, the securing system 140 has the additional advantage of allowing a cap 105 to remain secure within the hood 110 even when the hood 110 and cap 105 are removed from the wearer's head. One of the reasons why hooded garments 115 are so popular is that the hood 110 is conveniently attached to the garment so it is easy to don and doff without having to worry about holding or misplacing the hood 110. With the current invention, the same convenience can be provided with a cap 105 and hood 110 combination. Without the securing system 140, when a wearer wants to take the hood 110 and cap 105 off his or her head, the wearer must either hold the cap 105 or set it down and risk losing it. However, with the present invention, a wearer may simply remove the cap 105 and hood 110 from the head in a single motion and the cap 105 will remain secured within the hood 110 by action of the band 145. FIG. 2A shows a side view, and FIG. 2B shows a rear view of a hooded garment 115 including a securing system 140 with the hood 110 and cap 105 doffed. As can be seen, the cap 105 is securely stored within the hood 110. From the position shown in the FIGS. 2A and 2B, the cap 105 and hood 110 can be re-donned by the wearer simply by pulling forward on the bill 130 of the cap 105 and both the cap 105 and the hood 110 can be placed on the head in a single motion.

The band 145 of the securing system 140 can take any of various forms such as those that will be described herein. The band may be a solid piece of material or may be made of several different pieces. In one version, the band may include an elastic portion over at least a portion of its length so that the band asserts an elastic pressure against the cap 105 when in use. In one version, the entire band 145 may be elastic. The band 145 may include a center portion 155 that contacts the front of the cap 105 and side portions 160 that are closer to the hood 110. In one version, the center portion may be made of an elastic material while the side portions may be made of a material that is less elastic. In another version, the center portion may be less elastic than the side portions. For example, in one particular version, the band 145 may include elastic side portions 160 and an inelastic transparent central portion 155. In yet another version, a combination of elastic and less-elastic materials can be used throughout the length of the band 145. Examples of materials that may be used in the band 145 and other parts of the securing system 140 include elastic materials such as one or more of polymers of isoprene, cauotchouc, polyisoprene, bungee cords or straps, elastomers, elastin, styrene butadiene, polyacrylics, polyvinyl acetate, polyvinyl chloride, neoprene, mesh, polyurethane, natural rubber, monomer of isoprene, latex, lycra, emulsion styrene butadiene rubber, and the like, and/or less elastic materials such as one or more of cork cambium, strings, threads, wood, plastic, animal skin or hyde, hair, plant or tree roots, spider webbing, hemp, organic hemp, cotton, Kevlar, carbon fiber, fiberglass, proteins, metal, mud, stucco, other fabrics, a hook and loop fastener, such as Velcro, solar panels and reflectors, polytetrafluoroethylene, stretched polytetrafluoroethylene, and the like.

The band 145 may be attached 150 to the hood 110 in any conventional manner. For example, the band 145 may be sewn or glued to the inside of the hood 110 or may be attached by a removable means, such as buttons, snaps, clips, hook and loop fastener such as Velcro, ties, knots, loops, adhesives, magnetics and the like. The band 145 may be attached 150 to the hood 110 in any desirable position. For example, the securing system 140 may be designed so that the band 145 is located where it rests across a wearer's forehead, just above the nose, just below the nose, or across the mouth or chin when the hood is worn without a cap, depending on the position the wearer wants the hood to reside when in use. As should be evident, if the band is attached so that it lands in a lower position, when the band 145 is used to secure a cap 105 wherein a mating hook and loop fastener is affixed to the cap to prevent the cap from separating from the hood or the hood garment, the hood 110 will rest further back on the head. Similarly, a higher positioned band 145 will result in a more forward resting hood 110 in use. In one version, the attachment mechanism 150 can include a way to adjust the position of the band 145, such as by providing different buttons within the inside of the hood 110 or by providing a large hook and loop fastener region that allows the band 145 to be adjustably positioned.

Figure 3:
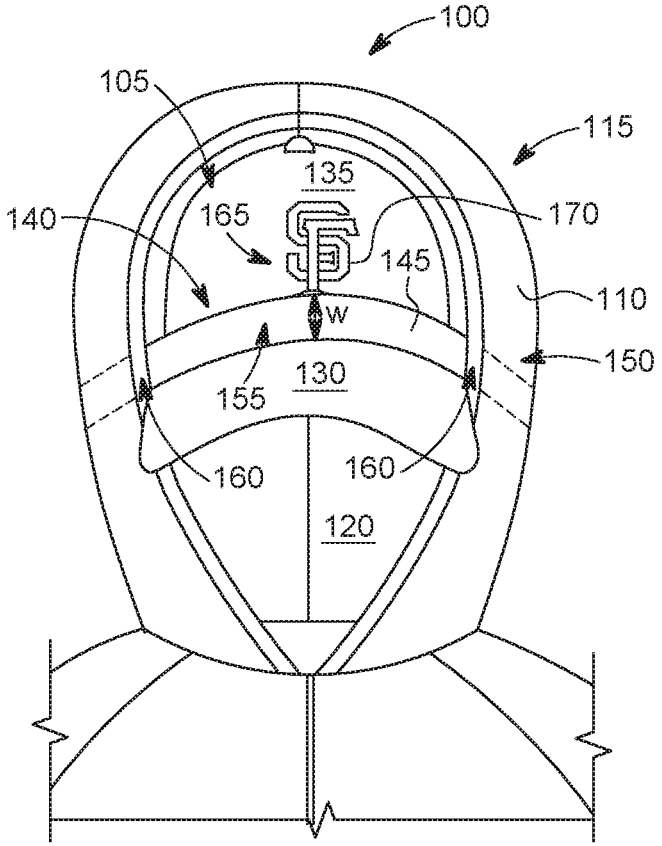
FIG. 3 is a schematic front view of an article of apparel in accordance with another version of the invention.

In one version, the securing system 140 may be designed and dimensioned to provide a desired effect. For example, as shown in FIG. 3, often a cap includes a banner portion 165 along its front face of the head portion 135. An image 170, such as a logo, motto, name, picture, drawing, personal or political statement or the like is often provided on the banner portion 165, such as the sports team logo shown in FIG. 3. The image 170 is often something of importance to the wearer and is something the wearer wishes to display as part of his or her outfit. Accordingly, in one version of the invention, the band 145 of the securing system 140 is designed and dimensioned to so as to minimize its obstruction of the cap image 170. In one particular version, the width, w, of the band 145 is selected so that it does not obscure the image 170. It is not always necessary that the band 145 completely leave the image 170 uncovered. Many images, like the one shown in FIG. 3, are sufficiently well-known, that a slight obstruction of the image 170 is not detrimental to the conveyance of the image 170. After studying numerous caps 105 containing images 170, it has been determined that it is desirable in one version of the invention to have the width, w, be about 1.25 inches or less. In other versions, w can be about 1.125 inches or less, about 1 inch or less, about 0.875 inches or less, about 0.75 inches or less, about 0.625 inches or less, or about 0.5 inches or less. In one particular version, w is about 0.625 inches. The band 145 also has a length and a thickness. The width, w, is the dimension of the band 145 extending generally in the up-and-down direction when the hood on the wearer's head and the wearer is standing, as can be seen from FIG. 3.

In another version similar to the design shown in FIG. 3, the securing system 140 may comprise a central portion 155 that is a different width, w, than the side portions 160. For example, in one version, the central portion may have a width, w, as described above while the side portions 160 have a width greater than that of the central portion 155. Alternatively or additionally, the central portion 155 may be transparent or have a transparent portion that allows the image 170 to be viewed. Similarly, the central portion 155 may include a window of no material through which the image 170 is visible.

Alternative securing system 140 designs may be employed to maintain and/or highlight the image 170 or the message of the image 170. For example, the band 145 may be a color or design that is part of or highlights the image 170. Alternatively or additionally, the band 145 may include a banner area on its central portion 155 and/or side portions 160. The banner area on the band 145 may be printed one or more images, such as an image similar to or complementary to the image 170 on the cap 105.

Figure 4:
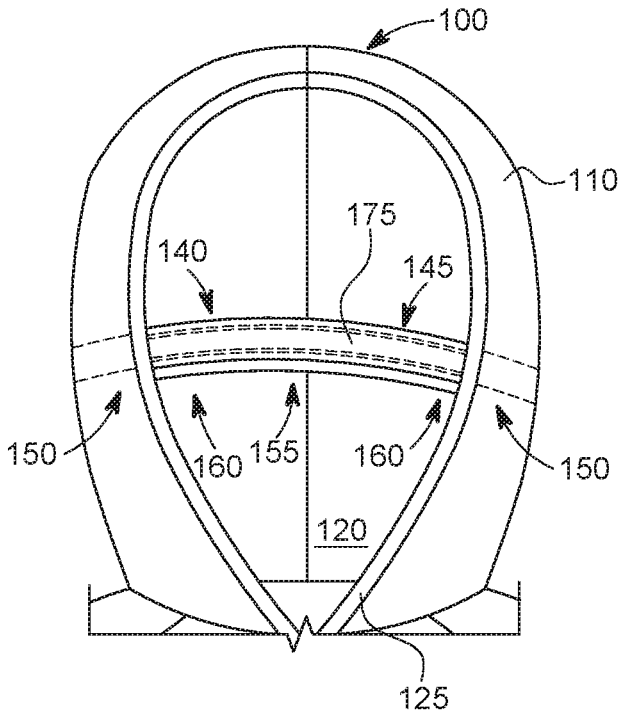
FIG. 4 is a schematic front view of an article of apparel in accordance with another version of the invention.

A version of the securing system 140 is shown in FIG. 4. In FIG. 4, the cap 105 is not shown for the purpose of clarity. In the version of FIG. 4, the cap-securing system 140 comprises a band 145 made up of a single band 175 of elastic material. In this particular version, the attachment 150 of the band 145 to the hood comprises a solid band of material with bungee cords sewn underneath the elastic.

Figure 5:
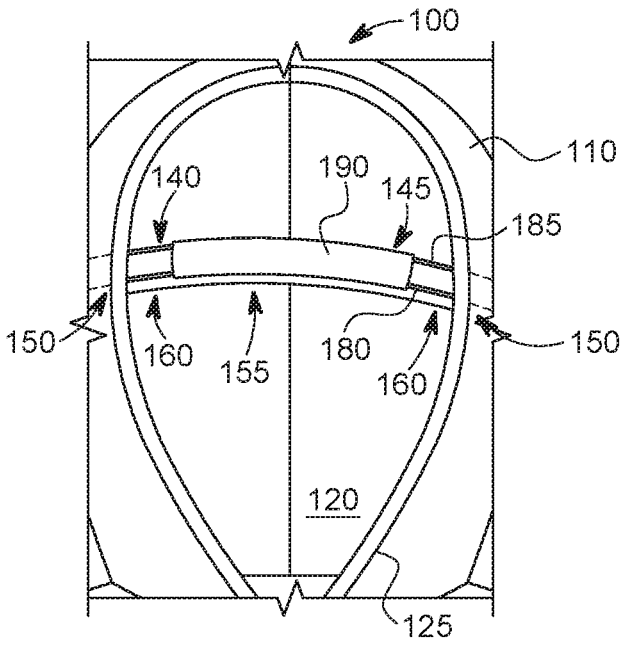
FIG. 5 is a schematic front view of an article of apparel in accordance with another version of the invention.

Another version of the securing system 140 is shown in FIG. 5. FIG. 5 is again shown without the cap 105 for the purpose of clarity. In the version of FIG. 5, the securing system 140 comprises a band 145 made up of a lower cord 180 and an upper cord 185 that extend across the front opening of the hood 110. In the central portion 155, a band of material 190 is attached to the cords 180, 185. The cords 180, 185 may be attached to the inside of the hood 110 in any manner, such as by buttons, sewn thread, staples, weaves, ties, adhesives, bonds, melted rubber or the like, sleeves, magnets, braids, a hook and loop fastener such as Velcro, or the like. In one version, the lower cord 180 and/or upper cord 185 are bungie cords. For example, the cords may be made of one or more of convention bungee or elastic material or other less-elastic material such as those listed above. The cords may have a cross-sectional shape that is round, circular, oval, square, rectangular or other polygon, and may have a cross-sectional size of from about 0.25 to about 0.125 inches. The central band 190 may be made of any of the materials discussed above and may include any of the features discussed above in association with the band 145.

In another version, the band 145 of the securing system 140 may be made of a material that is not elastic. In this version, the band 145 may loosely be positioned in front of the cap 105 to help keep the cap from falling out of the hood. Alternatively, the band 145 may include an attachment mechanism for attaching it to the cap. For example, the band 145 may include one or more of a button, sewn thread, staples, weaves, ties, adhesives, bonds, melted rubber or the like, sleeves, magnets, braids, a hook and loop fastener such as Velcro, or the like to help attach it to the front of the cap 105 when the front of the cap is worn over a wearer's forehead.

In one version, the hooded garment 115 comprises a hooded rain or wind jacket, such as a golfer's rain jacket. In this version, the securing system 140 can help secure a golfer's cap on the golfer's head during a rain and/or wind storm. Many professional golfers are paid for wearing a company's logo on their cap, but the logo often can go unseen when the golfer must wear a hood in inclement weather. With the garment 115 according to this version of the invention, the golfer can display his or her hat in any weather condition. The band 145 and/or other parts of the securing system 140 can be made of a water resistant material, such as stretched polytetrafluoroethylene or Gortex.

The securing system 140 may also be used without a cap 105. For example, in one version of use, the securing system 140 serves as a system for keeping the hood on a wearer's head at a desirable location without the need to use a drawstring. In another version, the securing system 140 can be used to secure an object other than a cap 105 to the user's head. For example, a user who is exercising may want to wear a towel around their head to pick up sweat. Alternatively, ice or an ice pack could be held against an injured portion of a user's head using the securing system 140 and band 145. As should also be evident from viewing FIGS. 1, 2A and 2B, the securing system 140 and band 145 in the hood 110 have additional uses. For example, the wearer could remove the cap 105 from the hood 110 and use the securing system 140 to carry other objects. In this way, the hood 110 could use be used to carry any object that fits in the hood 110, such as a ball, glove, lunch, groceries, and the like. In another use, the band 145 of the securing system 140 could be incorporated into other devices, such as goggles, sleep apnea headgear, a baseball catcher's mask or the like. The elastic nature of the band would also allow the band 145 to be used as separate tool, such as a bungee cord for securing an object or as a slingshot or similar tool.

Figure 6:
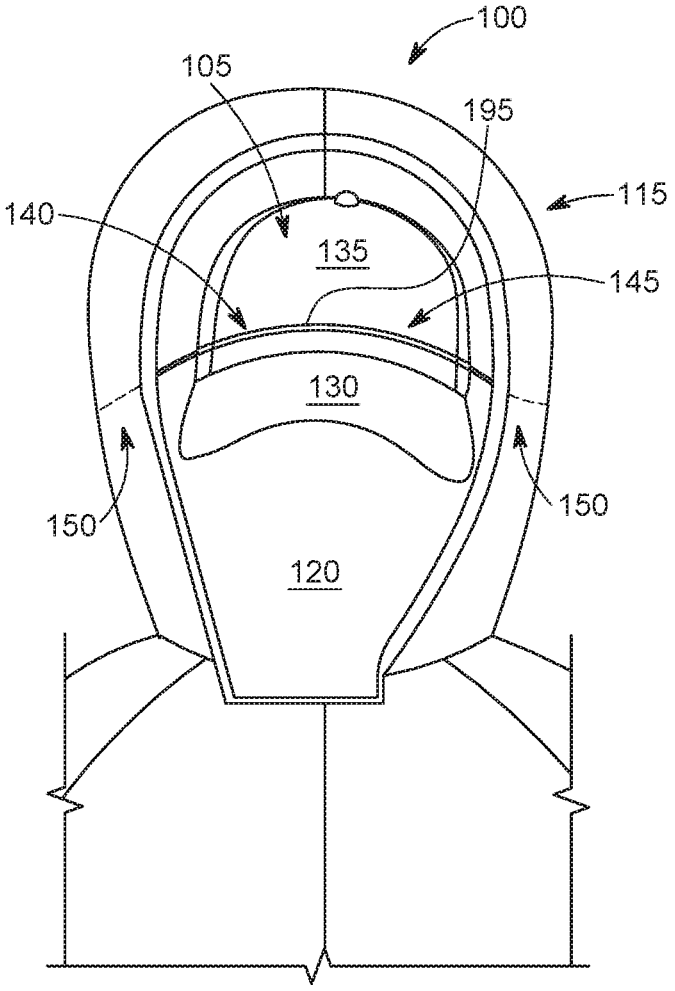
FIG. 6 is a schematic front view of an article of apparel in accordance with another version of the invention.

Another version of the system 100 according to the invention is shown in FIG. 6. The version of FIG. 6 is similar to the version of FIG. 1. In this version, the securing system 140 comprises a band 145 that is made up of a single cord 195. The cord 195 may be attached to the inside of the hood 110 in any manner, such as by being sewn in sleeves that allow the cords to slide therein. Additionally or alternatively, the cord 195 may be attached by a spring loaded clip or clamp that can slide up and down the cord to tighten or loosen the cord at the aiglet. In one version, the cord 195 may be a bungee cord made of conventional bungee material as known in the art. The cord 195 may alternatively or additionally be made of one or more of the materials discussed above. The cord 195 may have a cross-sectional shape that is round, circular, oval, square, rectangular or other polygon, and may have a cross-sectional size of from about 0.25 to about 0.125 inches.

Figure 7:
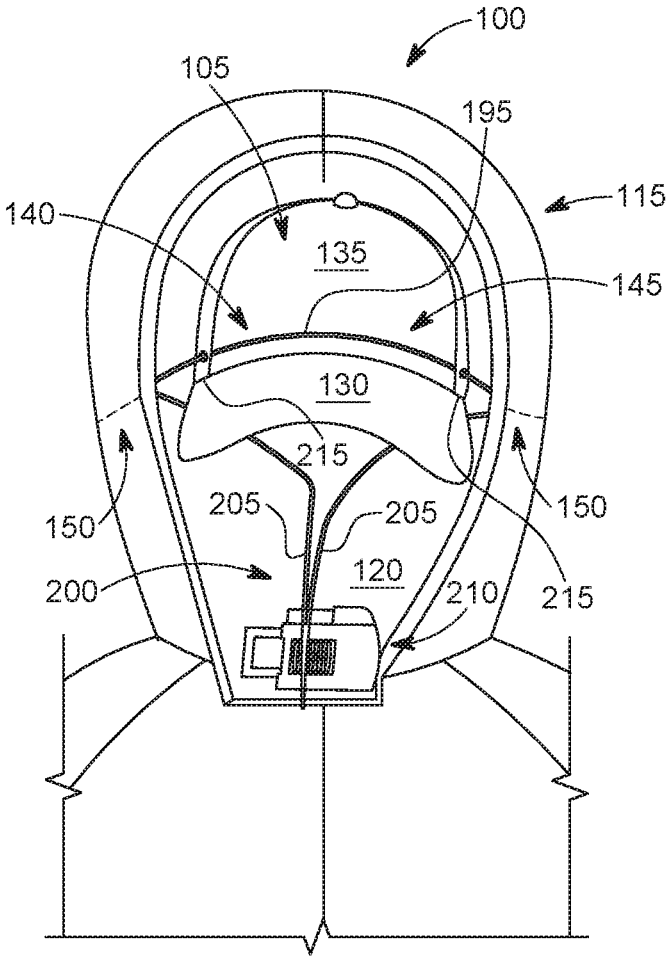
FIG. 7 is a schematic front view of an article of apparel in accordance with another version of the invention.

FIG. 7 illustrates a version of the invention in which the securing system 140 is adjustable in terms of its tightness. In the version shown, the securing system 140 includes a band 145 comprising a cord 195 similar to the one in FIG. 6. In this version, the cord 195 is connected to the hood 110 at attachment 150 in a manner so that the cord can slide therethrough. For example, the attachment 150 may comprise a loop piece of fabric with a tunnel. Alternatively, the attachment 150 may comprise a hole that extends through the hood 110 so that the cord can extend through and to the outside of the hood 110. The cord 195 includes end portions 205 that extend into an adjustment clip 210 that is capable of clamping the cord ends 205 so that the effective length of the cord 195 may be adjusted. The clip 210 may be any conventional clip, such as any conventionally available spring-loaded clip. Alternatively, there may be two clips provided, one for each end of the cord 205.

In use, a wearer of the version of FIG. 7 can slide the ends 205 of the cord 19 through the clip 210 to create a desired tightness of the securing system 140. In addition, the cap 205 may be provided with two holes 215 on each side of the cap 105 near or on the bill 130. The cord 195 may pass through the holes 215 to help more securely connect the cord 195 to the cap 105.

Figure 8A:
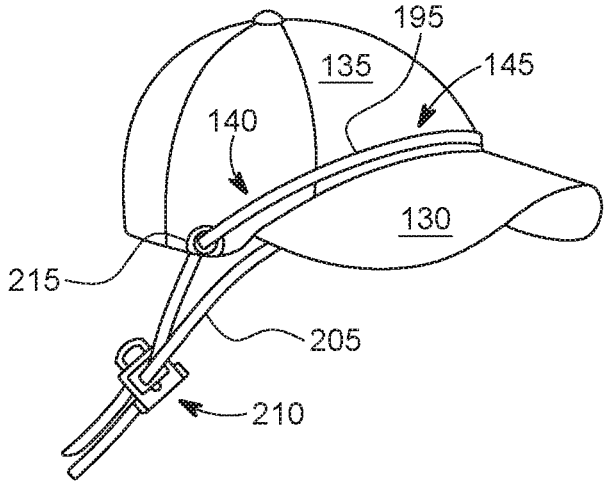
FIGS. 8A and 8B are schematic side and front views, respectively, of the cap-securing system of FIG. 7 in separate use.
Figure 8B:
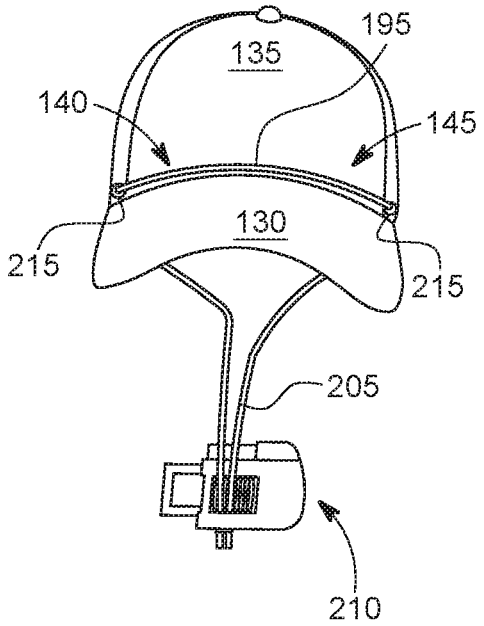

Another advantage of the securing system 140 as shown in FIG. 7 is that the securing system 140 can be removable from the hooded garment 115. In the version shown, the ends 205 of the cord 195 may be removed from the clip 205, slid back through the attachment 150 in the hood 110, and then reattached to the clip 210. The cap 105 and the securing system 140 may then be used separate from the hooded garment 115, as shown in FIGS. 8A and 8B. When used separately, the securing system 140 of FIGS. 8A and 8B can be tightened to a desired level. For example, the cord 195 can be pulled through the clip 210 to tighten the cap onto the head of the wearer so that it remained securely on the head. This can be particularly useful when a cap is sized too large for the wearer's head. Alternatively, the cord 195 could be loosened so that it dangles either behind or in front of the neck of the wearer. In this manner, the cap-securing system 140 can serve as a tether for the cap 105 so that the cap and securing system 140 will remain around the wearer's neck when the cap is doffed.

Figure 9:
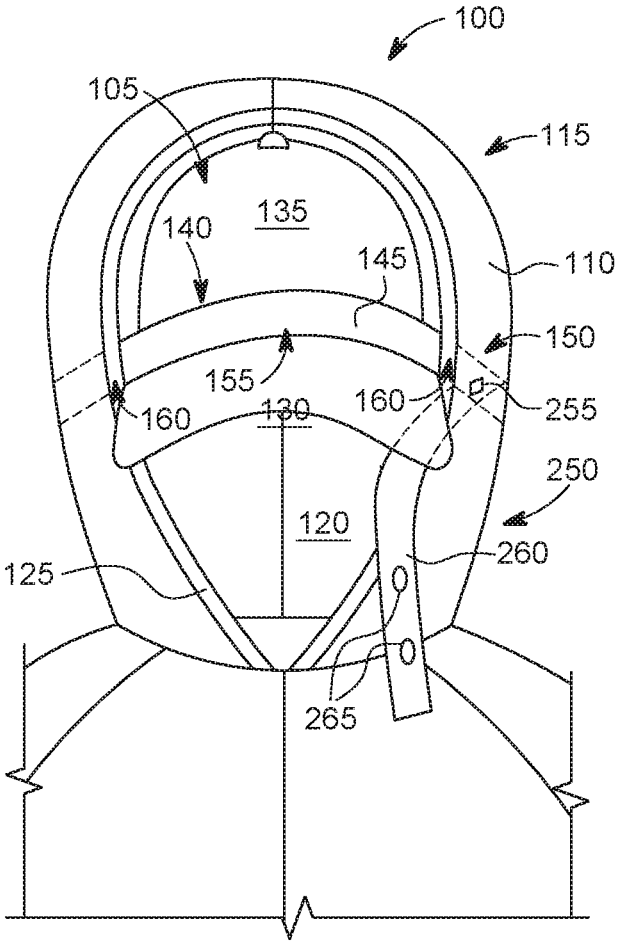
FIG. 9 is a schematic front view of an article of apparel in accordance with another version of the invention.

Another version of the securing system 140 is shown in FIG. 9. In this version, the securing system 140 includes a band 145 that is similar to the versions of the band 145 discussed in any of the embodiments discussed above. In addition, in the version of FIG. 9, the band further includes a dangling member 250. The dangling member 250 may be, as shown in FIG. 9, a continuation of the band 145, or may be a separate member. As shown in FIG. 9, the band 145 extends across the opening in the hood 110 as discussed above. It is also attached 150 to the hood 110 as discussed above. However, in this version, the band 145 is not attached at an end. Instead, the band 145 is attached 150 at an intermediate portion 255, and there is an extension 260 of the length of band 150, and this extension 260 forms the dangling member 250. The dangling member 250 extends through the opening in the hood 110 and hangs in front of the chest and/or shoulder area of the user. The dangling member 250 can contain one or more attachment mechanisms 265 along its length. In the version shown, the attachment mechanisms are holes or eyelets in the dangling member 250. In addition or alternatively, the attachment mechanisms can be snaps, clips, Velcro, or any other type of fastener known in the art.

Figure 10:
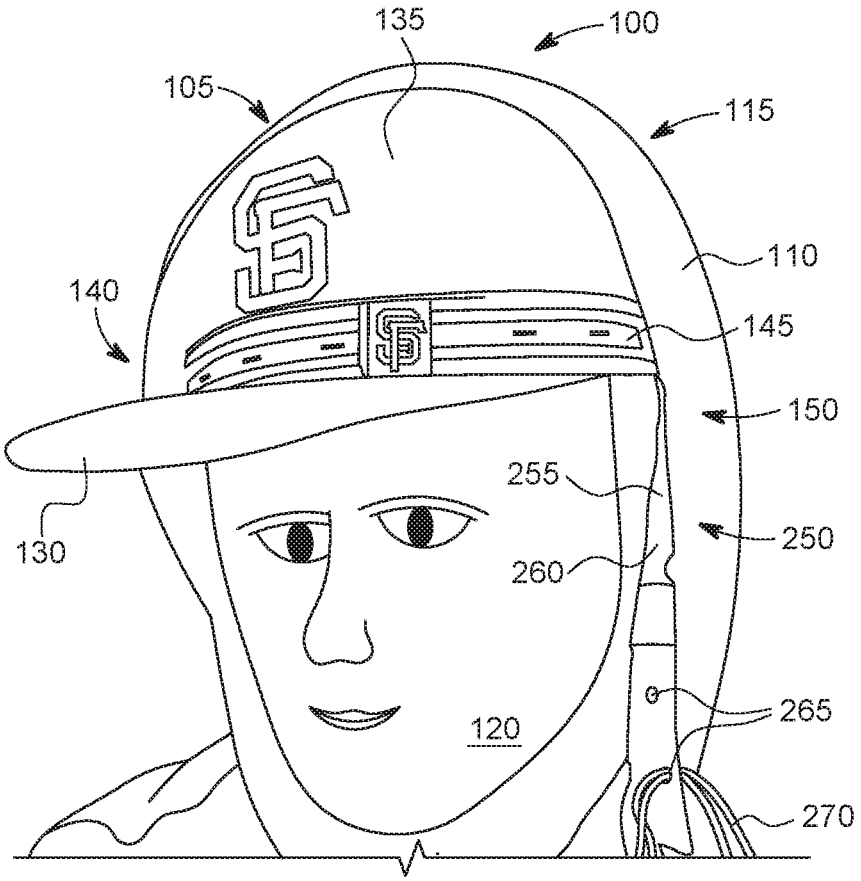
FIG. 10 is a schematic front view of the article of apparel in accordance with the version of FIG. 9 in use.

The one or more attachment mechanisms 265 may be used to conveniently store any desired product or implement. For example, FIG. 10 shows a version of the securing system 140 of FIG. 9 in use. In this version, the dangling member 250 is used to carry a headset 270 for a smart phone or other music player in one of its attachment mechanisms 165. Additionally or alternatively, an attachment mechanism 265 could be used to carry any other item, such as a cigar or cigarette and/or paraphernalia related thereto, e-cigarette, vaporizer, glasses, small tool such as an allen wrench or T wrench, candy, sucker, pen or pencil, flower, feather, and small electronics such as a microphone. As also shown in FIG. 10, the band 145 can include a banner portion for displaying an image, such as a logo, picture, motto, or the like.

Figure 11A:
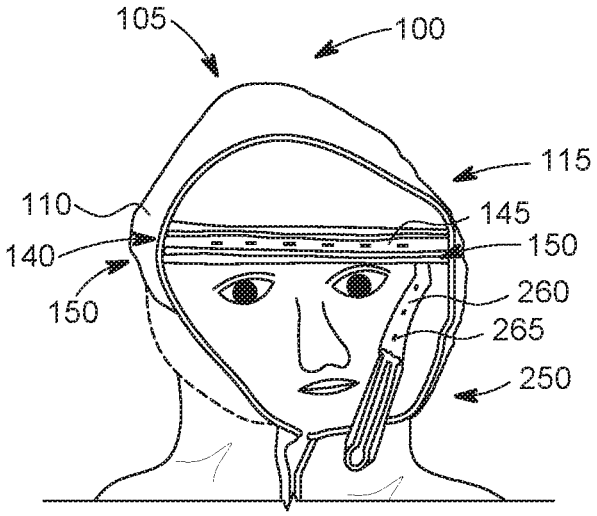
FIGS. 11A and 11B are schematic front views of the article of apparel in accordance with the version of FIG. 9 in use without a cap.
Figure 11B:
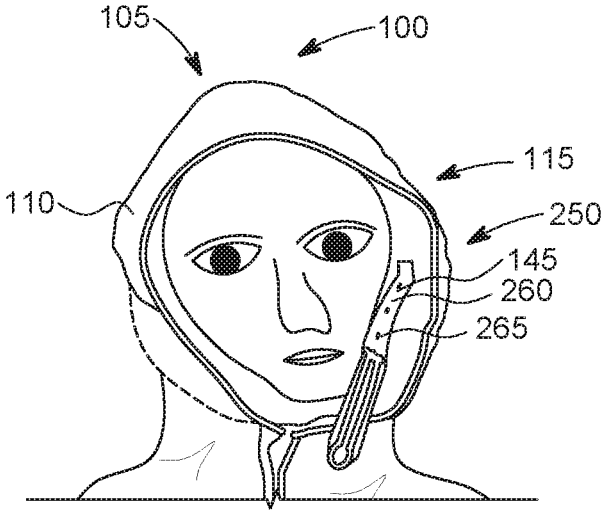

In another version, the dangling member 250 can be used separately. For example, as shown in FIG. 11A, the dangling member 250 can be on a strap 145 that is used to secure the hood 110 to the head of a user without a cap being worn. In another version, as shown in FIG. 11B, the dangling member 250 can dangle from the hood 110 and not be used as a cap-securing and/or hood securing system.

In another version, the band 145 with or without a dangling member 250 can be removed from the hood 110 and used separately. For example, the band 145 can be used as a lanyard. In one particular version, the band 145 can be a lanyard having laminated name tag that can clip to the end of the band 145. Alternatively, the lanyard can be used to clip keys or other items, such as by use of a carabiner.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention. Therefore, any appended claims should not be limited to the description of the preferred versions contained herein and should include all such alterations, permutations, and equivalents as fall within the true spirit and scope of the present invention.

What is claimed is:

1. Apparel comprising:

a hooded garment that includes a hood attached to the hooded garment;

a cap having a front that is adapted to be worn over a wearer's forehead and having a first part of a hook and loop fastening mechanism; and a securing system associated with the hood of the hooded garment;

wherein the securing system comprises a band having a second part of the hook and loop fastening mechanism that fastens to the first part of the hook and loop fastening mechanism of the front of the cap to secure the cap to the wearer's head when the hood is up and to secure the cap within the hood when the hood is down to prevent the cap from separating from the hooded garment, wherein the hook and loop fastening mechanism fastens to the front of the cap to prevent the cap from separating from the hood or the hooded garment.

2. The apparel according to claim 1 wherein the band extends from one side of the interior of the hood, across the front of the cap and to the other side of the interior of the hood.

3. The apparel according to claim 1 wherein the band comprises an elastic portion so that the band compresses the front of the cap when in use.

4. The apparel according to claim 1 wherein the front of the cap comprises a bill and a banner and wherein the band contacts the cap between the bill and the banner.

5. The apparel according to claim 4 wherein the band is sized and shaped to not obstruct an image on the banner of the cap.

6. The apparel according to claim 4 wherein the band has a width extending in the direction between the bill and the banner and wherein the width is less than about 1.25 inches.

7. The apparel according to claim 1 wherein the band is detachable from the hood to be separately used.

8. The apparel according to claim 1 wherein the band is attached to the interior of the hood by a hook and loop fastener.

* * * * *